US006422927B1

(12) United States Patent
Zuniga

(10) Patent No.: US 6,422,927 B1
(45) **Date of Patent: *Jul. 23, 2002**

(54) CARRIER HEAD WITH CONTROLLABLE PRESSURE AND LOADING AREA FOR CHEMICAL MECHANICAL POLISHING

(75) Inventor: Steven M. Zuniga, Santa Clara, CA (US)

(73) Assignee: Applied Materials, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/470,820

(22) Filed: Dec. 23, 1999

Related U.S. Application Data

(60) Provisional application No. 60/114,182, filed on Dec. 30, 1998.

(51) Int. Cl.[7] ..... B24B 5/00

(52) U.S. Cl. ..... 451/288; 451/398; 451/41; 451/285; 451/388

(58) Field of Search ..... 451/288, 398, 451/388, 287, 41, 285

(56) References Cited

U.S. PATENT DOCUMENTS

| | | | | |
|---|---|---|---|---|
| 4,918,869 A | | 4/1990 | Kitta | |
| 5,193,316 A | | 3/1993 | Olmstead | |
| 5,205,082 A | | 4/1993 | Shendon et al. | |
| 5,423,716 A | | 6/1995 | Strasbaugh | |
| 5,449,316 A | | 9/1995 | Strasbaugh | |
| 5,584,751 A | | 12/1996 | Kobayashi et al. | |
| 5,624,299 A | | 4/1997 | Shendon | |
| 5,643,053 A | | 7/1997 | Shendon | |
| 5,643,061 A | | 7/1997 | Jackson et al. | |
| 5,759,918 A | | 6/1998 | Hoshizaki et al. | |
| 5,803,799 A | | 9/1998 | Volodarsky et al. | |
| 5,851,140 A | | 12/1998 | Barns et al. | |
| 5,879,220 A | | 3/1999 | Hasegawa et al. | |
| 5,957,751 A | | 9/1999 | Govzman et al. | |
| 5,964,653 A | | 10/1999 | Perlov et al. | |
| 6,056,632 A | | 5/2000 | Mitchel et al. | |
| 6,080,050 A | * | 6/2000 | Chen et al. | 451/388 |
| 6,116,992 A | * | 9/2000 | Prince | 451/288 |
| 6,162,116 A | * | 12/2000 | Zuniga et al. | 451/288 |

FOREIGN PATENT DOCUMENTS

| | | |
|---|---|---|
| EP | 0 841 123 A1 | 5/1998 |
| JP | 2243263 | 9/1990 |
| WO | WO 99/07516 | 2/1999 |

* cited by examiner

*Primary Examiner*—Joseph J. Hail, III
*Assistant Examiner*—Lee Wilson
(74) *Attorney, Agent, or Firm*—Fish & Richardson

(57) ABSTRACT

A carrier head for a chemical mechanical polishing apparatus a flexible membrane that applies a load to a substrate in a loading area with a controllable size. One pressurizable chamber in the carrier head controls the size of the loading area, and another chamber controls the pressure applied to the substrate in the loading area.

28 Claims, 11 Drawing Sheets

CARRIER HEAD WITH CONTROLLABLE PRESSURE AND LOADING AREA FOR CHEMICAL MECHANICAL POLISHING

Under 35 USC §119(e)(1) and 35 USC §120, this application claims the benefit of prior U.S. provisional application No. 60/114,182, filed Dec. 30, 1998.

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect" i.e., the tendency of the substrate edge to be polished at a different rate than the substrate center. The edge effect typically results in non-uniform polishing at the substrate perimeter, e.g., the outermost three to fifteen millimeters of a 200 millimeter (mm) wafer. A related problem is the so-called "center slow effect", i.e., the tendency of the center of the substrate to be underpolished.

SUMMARY

In one aspect, the invention is directed to a carrier head for a chemical mechanical polishing apparatus. The carrier head has a first pressurizable chamber at least partially bounded by a first flexible membrane, and a second pressurizable chamber positioned to apply a downward force to the first chamber. A lower surface of the first flexible membrane provides a first surface to apply a pressure to a substrate in a loading area having a controllable size, and the first and second chambers are configured such that a first pressure in the first chamber controls the pressure applied to the substrate in the loading area, and a second pressure in the second chamber controls the size of the loading area.

Implementations of the invention may include one or more of the following features. A vertically movable base may form at least part of an upper boundary of the second pressurizable chamber. A housing may be connectable to a drive shaft and a third chamber may be disposed between the housing and the base. A retaining ring may be connected to the base to maintain the substrate beneath the carrier head. A boundary between the first and second chambers may be formed by a rigid member or a flexible member, and the second chamber may form a generally annular volume or a generally solid volume. The lower surface of the first flexible membrane may provide a mounting surface for the substrate, or a second flexible membrane may extend beneath the first flexible membrane to provide a mounting surface for the substrate. The volume between the first flexible membrane and the second flexible membrane may define a third pressurizable chamber. The first flexible membrane may be movable into contact with an upper surface of the second flexible membrane in the loading area to apply pressure to the substrate. The lower surface of the first flexible membrane may be textured to provide fluid flow between the first and second flexible membranes when they are in contact.

A first support structure may positioned inside the first chamber, and the first flexible membrane may extends around an outer surface of the first support structure. A first spacer ring may be positioned outside the first chamber, and the first flexible membrane may extend in a serpentine path between the first structure and the first spacer ring, around an inner surface of the first spacer ring, and outwardly around an upper surface of the first spacer ring. A second support structure may be located in the third chamber between the first and second flexible membranes and positioned to surround the first supports structure. A second spacer ring may be located outside the third chamber above the second support ring, and the second flexible membrane may extend in a serpentine path between the second support structure and the second spacer ring, around an inner surface of the second spacer ring, and outwardly around an upper surface of the second spacer ring.

In another aspect, the invention is directed to a carrier head for chemical mechanical polishing having a base, a first flexible membrane portion, and a second flexible membrane portion. The first flexible membrane portion extends beneath the base and defines a first pressurizable chamber, and a lower surface of the first flexible membrane portion provides a mounting surface to apply a pressure to a substrate in a loading area having a controllable size. The second flexible membrane portion couples the first flexible membrane portion to the base and defines a second pressurizable chamber so that a first pressure in the first pressurizable chamber controls the pressure applied to the substrate in the loading area, and a second pressure in the second chamber controls the size of the loading area.

In another aspect, the invention is directed to a carrier head for chemical mechanical polishing having a base, a first flexible membrane portion, a second flexible membrane portion, and a third flexible membrane portion. The first flexible membrane portion extends beneath the base to define a first pressurizable chamber, and a lower surface of the first flexible membrane provides a mounting surface for a substrate. The second flexible membrane portion extends beneath the base and defines a second pressurizable chamber, and a lower surface of the second flexible membrane contacts a top surface of the first flexible membrane in a loading area having a controllable size. The third flexible membrane portion couples the second flexible membrane portion to the base and defines a third pressurizable chamber so that a first pressure in the second pressurizable chamber controls the pressure applied to the substrate in the loading area, and a second pressure in the third chamber controls the size of the loading area.

In another aspect, the invention is directed to a carrier head for chemical mechanical polishing having a first biasing member and a second biasing member. The first biasing member includes a first pressure chamber, and a lower surface of the first pressure chamber is bounded by a flexible membrane that provides a first surface to apply a load to a substrate in a loading area having a controllable size. The second biasing member is connected to the first biasing member, and the second biasing member controls the vertical position of the first biasing member so that the second biasing member controls the size of the loading area and the first biasing member controls the pressure applied to the substrate in the loading area.

In another aspect, the invention is directed to a carrier head for chemical mechanical polishing having a flexible membrane that provides a mounting surface for a substrate, means for controlling a size of a loading area in which a load is applied to the substrate, and means for controlling a pressure applied to the substrate in the loading area.

In another aspect, the invention is directed to a method for chemical mechanical polishing a substrate. In the method, a substrate is held against a polishing pad with a carrier head, a load is applied to the substrate in a loading area with a first chamber in the carrier head, the size of the loading area is controlled with a second chamber in the carrier head, and relative motion is created between the substrate and the polishing pad.

In another aspect, the invention is directed to a method of detecting a substrate in a carrier head for a chemical mechanical polishing system. In the method, a chamber in a carrier head is connected to a pressure source. The pressure in the chamber is measured as a function of time, and the derivative of the pressure in the chamber is calculated. Whether the substrate is adjacent a substrate receiving surface in the carrier head is determined from the derivative.

Implementations of the invention may include the following features. The substrate may be indicated as present if the derivative exceeds a critical value, or absent if if the derivative does not exceed a critical value.

Advantages of the invention may include the following. Both the pressure and the loading area of the flexible membrane against the substrate may be varied to compensate for non-uniform polishing. Non-uniform polishing of the substrate is reduced, and the resulting flatness and finish of the substrate are improved.

Other advantages and features of the invention will be apparent from the following description, including the drawings and claims.

BRIEF DESCRIPTION OF THE DRAWINGS

Like reference numbers are designated in the various drawings to indicate like elements. A reference number with a letter suffix indicates that an element has a modified function, operation or structure.

DETAILED DESCRIPTION

Figure 1:
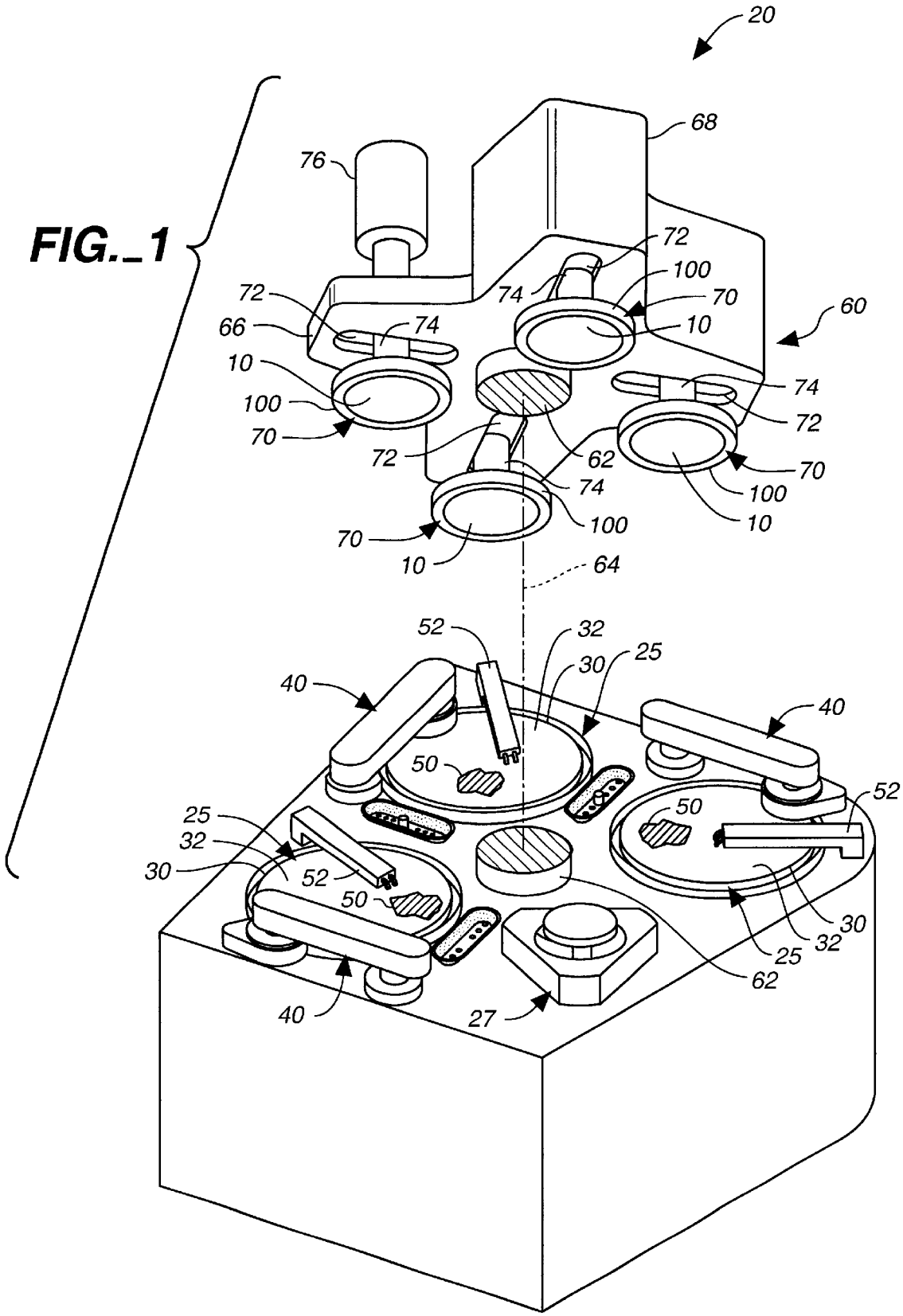
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. If substrate 10 is a six-inch (150 millimeter) or eight-inch (200 millimeter) diameter disk, then platen 30 and polishing pad 32 may be about twenty inches in diameter. If substrate 10 is a twelve-inch (300 millimeter) diameter disk, then platen 30 and polishing pad 32 may be about thirty inches in diameter. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations, and one of the carrier head systems receives a substrate from and delivers the substrate to the transfer station. The carousel motor may orbit the carrier head systems, and the substrates attached thereto, about the carousel axis between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads are positioned at and above the three polishing stations. Each carrier head 100 lowers a substrate into contact with polishing pad 32. The carrier head holds the substrate in position against the polishing pad and distributes a force across the back surface of the substrate. The carrier head also transfers torque from the drive shaft to the substrate.

Figure 2:
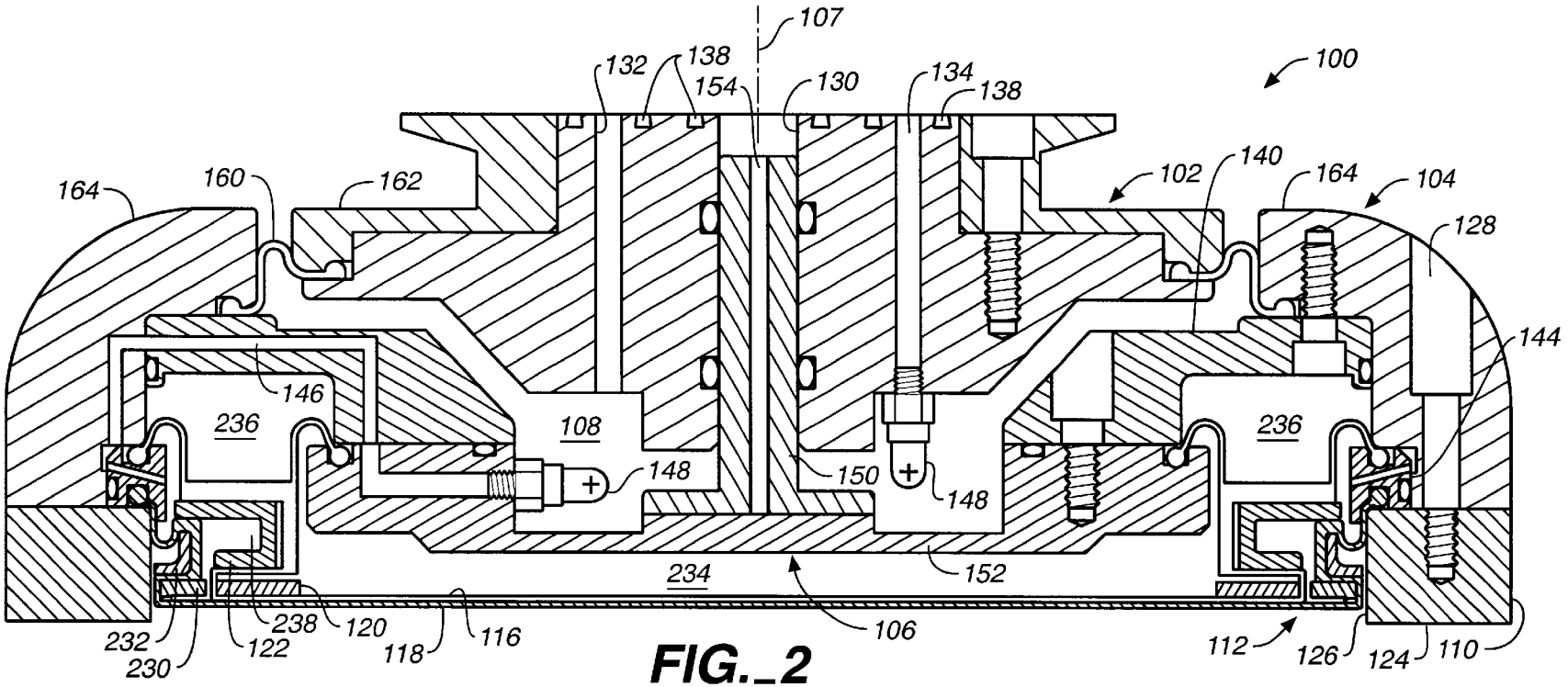
FIG. 2 is a schematic cross-sectional view of a carrier head according to the present invention.

Referring to FIG. 2, carrier head 100 includes a housing 102, a base assembly 104, a gimbal mechanism 106 (which may be considered part of the base assembly), a loading chamber 108, a retaining ring 110, and a substrate backing assembly 112 which includes three pressurizable chambers, such as a floating upper chamber 236, a floating lower chamber 234, and an outer chamber 238. A description of a similar carrier head may be found in U.S. application Ser. No. 08/861,260 by Zuniga, et al., filed May 21, 1997, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference.

The housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A vertical bore 130 may be formed through the housing, and three additional passages (only two passages 132, 134 are illustrated in FIG. 2) may extend through the housing for pneumatic control of the carrier head. O-rings 138 may be used to form fluid-tight seals between the passages through the housing and passages through the drive shaft.

The base assembly 104 is a vertically movable assembly located beneath housing 102. The base assembly 104 includes a generally rigid annular body 140, an outer clamp ring 164, gimbal mechanism 106, and a lower clamp ring 144. A passage 146 may extend through the body of the gimbal mechanism, the annular body, and the clamp ring, and two fixtures 148 may provide attachment points to connect a flexible tube between housing 102 and base assembly 104 to fluidly couple passage 134 to one of the chambers in substrate backing assembly 112, e.g., chamber 238. A second passage (not shown) may extend through annular body 140, and two fixtures (also not shown) may provide attachment points to connect a flexible tube between housing 102 and base assembly 104 to fluidly couple the unillustrated passage in the housing to a second chamber in substrate backing assembly 112, e.g., chamber 236.

The gimbal mechanism 106 permits the base assembly to pivot with respect to housing 102 so that the retaining ring may remain substantially parallel with the surface of the polishing pad. Gimbal mechanism 106 includes a gimbal rod 150 which fits into vertical bore 130 and a flexure ring 152 which is secured to annular body 140. Gimbal rod 150 may slide vertically along bore 130 to provide vertical motion of base assembly 104, but it prevents any lateral motion of base assembly 104 with respect to housing 102 and reduces momement generated by the lateral force of the substrate against the retaining ring. Gimbal rod 150 may include a passage 154 that extends the length of the gimbal rod to fluidly couple bore 130 to a third chamber in substrate backing assembly 112, e.g., chamber 234.

The loading chamber 108 is located between housing 102 and base assembly 104 to apply a load, i.e., a downward pressure or weight, to base assembly 104. The vertical position of base assembly 104 relative to polishing pad 32 is also controlled by loading chamber 108. An inner edge of a generally ring-shaped rolling diaphragm 160 may be clamped to housing 102 by an inner clamp ring 162. An outer edge of rolling diaphragm 160 may be clamped to base assembly 104 by outer clamp ring 164. Thus, rolling diaphragm 160 seals the space between housing 102 and base assembly 104 to define loading chamber 108. A first pump (not shown) may be fluidly connected to loading chamber 108 by passage 132 to control the pressure in the loading chamber and the vertical position of base assembly 104.

The retaining ring 110 may be a generally annular ring secured at the outer edge of base assembly 104, e.g., by bolts 128. When fluid is pumped into loading chamber 108 and base assembly 104 is pushed downwardly, retaining ring 110 is also pushed downwardly to apply a load to polishing pad 32. A bottom surface 124 of retaining ring 110 may be substantially flat, or it may have a plurality of channels to facilitate transport of slurry from outside the retaining ring to the substrate. An inner surface 126 of retaining ring 110 engages the substrate to prevent it from escaping from beneath the carrier head.

Figure 3:
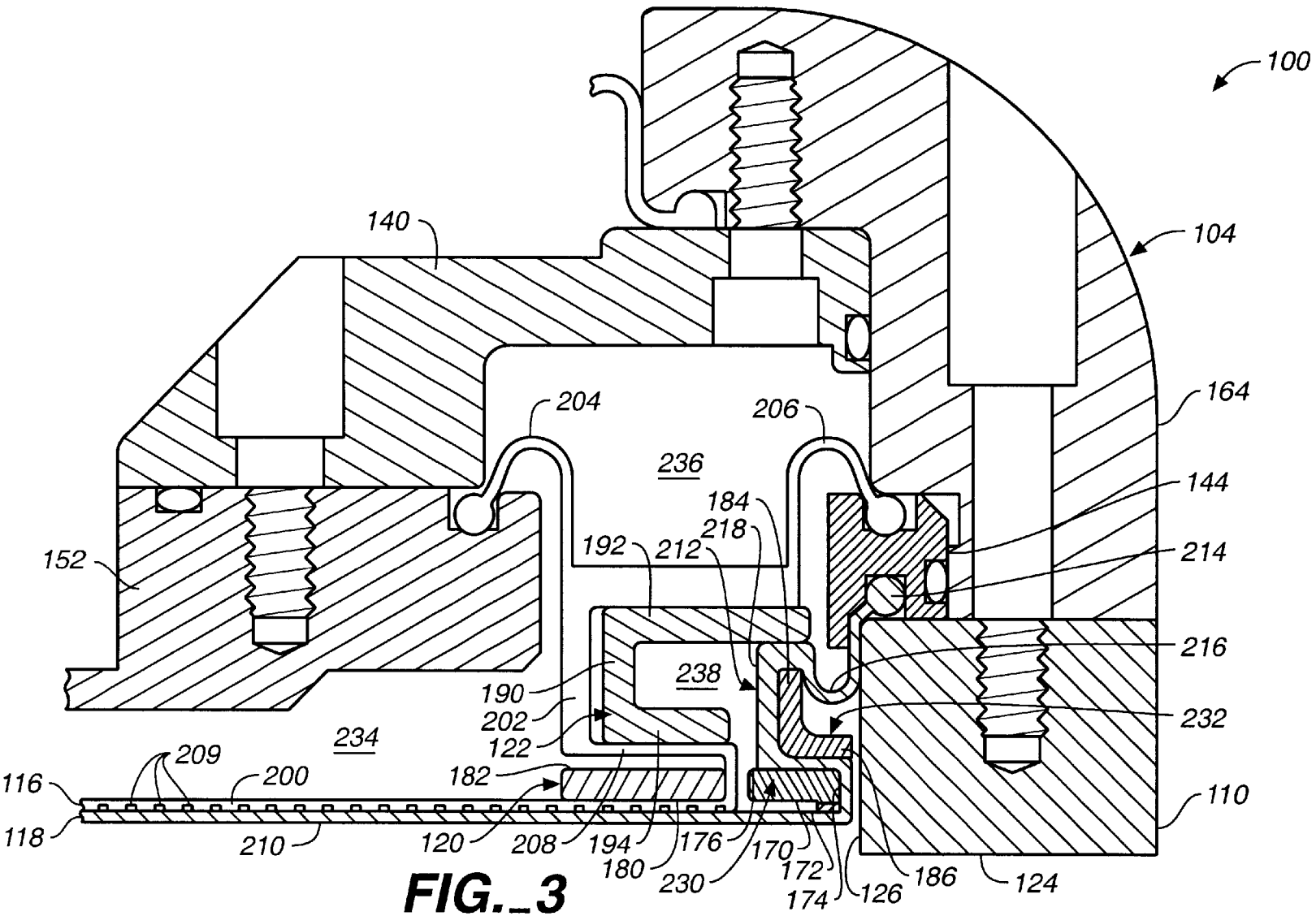
FIG. 3 is an enlarged view of a substrate backing assembly from the carrier head of FIG. 2.

Referring to FIGS. 2 and 3, substrate backing assembly 112 includes a flexible internal membrane 116, a flexible external membrane 118, an internal support structure 120, an external support structure 230, an internal spacer ring 122, and an external spacer ring 232. Support structures 120 and 230 and spacer rings 122 and 232 may be "free-floating", i.e., not secured to the rest of the carrier head, and may be held in place by the internal and external flexible membranes.

The flexible internal membrane 116 includes a central portion 200 which will apply pressure to the substrate in a controllable area, a relatively thick annular portion 202 with an "L-shaped" cross-section, an annular inner flap 204 that extends from the corner of L-shaped portion 202, an annular outer flap 206 that extends from the outer rim of L-shaped portion 202, and a perimeter portion 208 that extends around internal support structure 120 to connect L-shaped portion 202 and central portion 200. The rim of inner flap 204 is clamped between flexure ring 152 and annular body 140, whereas the rim of outer flap 206 is clamped between outer clamp ring 164 and lower clamp ring 144. The volume between base assembly 104 and internal membrane 116 that is sealed by inner flap 204 provides a pressurizable floating lower chamber 234. The annular volume between base assembly 104 and internal membrane 116 that is sealed by inner flap 204 and outer flap 206 defines a pressurizable floating upper chamber 236. A second pump (not shown) may be connected to the unillustrated passage to direct fluid, e.g., a gas, such as air, into or out of the floating upper chamber 236. A third pump (not shown) may be connected to bore 130 to direct a fluid, e.g., a gas, such as air, into or out of floating lower chamber 234. The second pump controls the pressure in the upper chamber and the vertical position of the lower chamber, and the third pump controls the pressure in the lower chamber. As explained in greater detail below, the pressure in floating upper chamber 236 will control a contact area of internal membrane 116 against a top surface of external membrane 118. Thus, the second pump controls the area of the substrate against which pressure is applied, i.e., the loading area, whereas the third pump controls the downward force on the substrate in the loading area.

The external membrane 118 includes a central portion 210 that extends below external support structure 230 to provide a mounting surface to engage the substrate, and a perimeter portion 212 that extends in a serpentine path between external support structure 230 and external spacer ring 232 to be secured to the base assembly. For example, an edge of the external membrane may be clamped between lower clamp ring 144 and retaining ring 110. The sealed volume between internal membrane 116 and external membrane 118 defines a pressurizable outer chamber 238. Thus, outer chamber 238 can actually extend below the lower chamber 234. A fourth pump (not shown) may be connected to passage 134 to direct fluid, e.g., a gas, such as air, into or out of outer chamber 238. The fourth pump controls the pressure in outer chamber 238.

The internal support structure 120 may be a generally rigid annular washer-shaped body located inside floating lower chamber 234 to maintain the desired shape of internal membrane 116. Alternatively, the internal support structure may be a disk-shaped body with a plurality of apertures therethrough. The disk-shaped support structure would provide a backing surface to prevent the substrate from being damaged due to warping.

The internal spacer ring 122 is a generally rigid annular body which may have a "C-shaped" cross-section. The internal spacer ring may include a cylindrical portion 190, an annular upper flange 192, and an annular lower flange 194. The internal spacer ring 122 may be located in outer chamber 238 above internal support structure 120. The annular lower flange 194 can be supported by the internal support structure, whereas annular upper flange 192 can extend over external support structure 230 and external spacer ring 232.

The internal membrane 116 is formed of a flexible and elastic material, such as an elastomer, an elastomer coated fabric, or a thermal plastic elastomer (TPE), e.g., HYTREL™ available from DuPont of Newark, Del., or a combination of these materials. Preferably, internal membrane 116 is somewhat less flexible than external membrane 118. As discussed above, a controllable region of central portion 200 of internal membrane 116 can contact and apply a downward load to an upper surface of external membrane 118. The load is transferred through the external membrane to the substrate in the loading area. The bottom surface of central portion 200 of internal membrane 116 may be textured, e.g., with small grooves, to ensure that fluid can flow between the internal and external membranes when they are in contact. The perimeter portion 208 of the internal membrane extends upwardly around an outer surface 180 of internal support structure 120, and inwardly between lower flange 194 of internal spacer ring 122 and an upper surface 182 of the internal support structure to connect to the lower edge of L-shaped portion 202. The L-shaped portion 202 of the internal membrane extends inside cylindrical portion 190 and over annular upper flange 192 of the internal spacer ring 122.

The external support structure 230 is located inside outer chamber 238 between internal membrane 116 and external membrane 118 to maintain the desired shape of external membrane 118 and to seal the external membrane against the substrate during vacuum-chucking. Specifically, external support structure 230 may have a generally rigid ring-shaped portion 170 with an annular projection 172 that extends downwardly from the rim of the ring-shaped portion. Alternatively, projection 172 may be positioned to contact a top surface of the external membrane to preferentially apply pressure to selected areas of the substrate, as discussed in U.S. application Ser. No. 08/907,810, by Steven M. Zuniga, et al., filed Aug. 8, 1997, entitled A CARRIER HEAD WITH LOCAL PRESSURE CONTROL FOR A CHEMICAL MECHANICAL POLISHING APPARATUS, and assigned to the assignee of the present invention, the entire disclosure of which is incorporated herein by reference. The projection 172 may be formed by adhesively attaching a layer of compressible material to a lower surface of ring-shaped portion 170.

The external spacer ring 232 is a generally annular member positioned between retaining ring 110 and external membrane 118. Specifically, external spacer ring 232 may be located above external support structure 230. External spacer ring 232 includes a cylindrical portion 184 and a flange portion 186 which extends outwardly toward inner surface 126 of retaining ring 110 to maintain the lateral position of the external spacer ring.

External membrane 118 is a generally circular sheet formed of a flexible and elastic material, such as chloroprene or ethylene propylene rubber, or silicone. As noted, central portion 210 of the external membrane defines a mounting surface for the substrate, whereas perimeter portion 212 extends in a serpentine fashion between external support structure 230 and external spacer ring 232 to be clamped between base assembly 104 and retaining ring 110. Specifically, perimeter portion 212 extends upwardly around an outer surface 174 of external support structure 230, inwardly between flange portion of external spacer ring 232 and an upper surface 176 of external support structure 230, upwardly around cylindrical portion 184 of external spacer ring 232, and then outwardly to a rim portion 214 which is clamped between lower clamp ring 144 and retaining ring 110 to form a fluid-tight seal. A "free span" portion 216 of the external membrane extends between rim portion 214 and the outer diameter of the upper surface of external spacer ring 232. The external membrane 118 may also include a thick portion 218 that extends upwardly between internal spacer ring 122 and external spacer ring 232. The external membrane may be pre-molded into a serpentine shape.

Figure 4A:
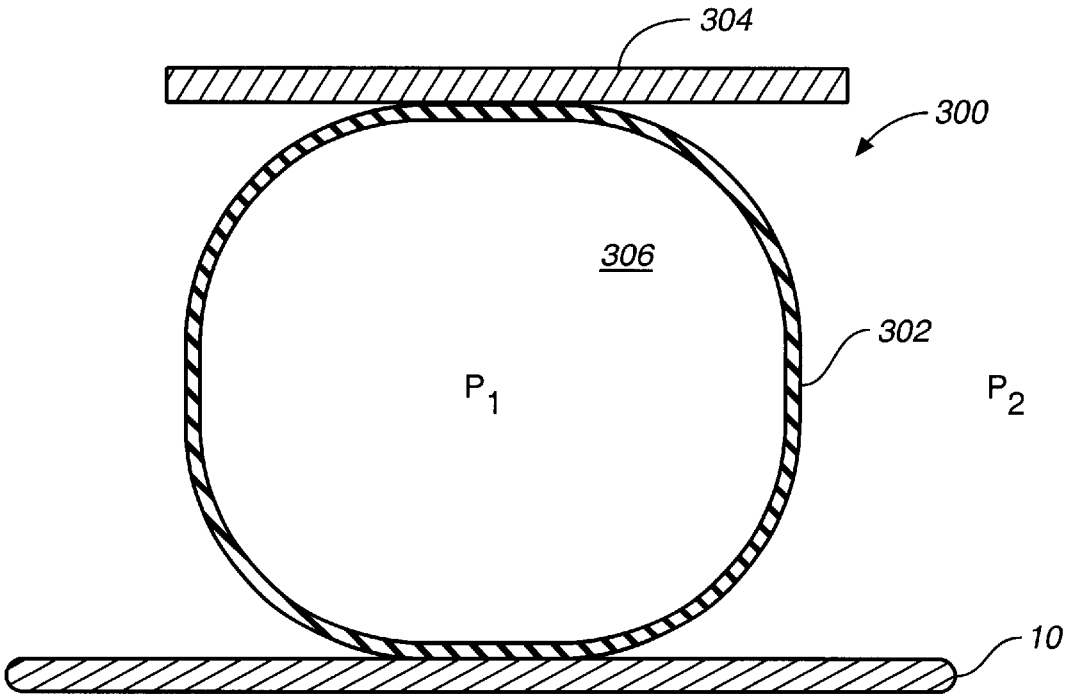
FIGS. 4A and 4B are schematic cross-sectional views illustrating the pressure and force distribution on a hypothetical flexible membrane.

In operation, fluid is pumped into or out of floating lower chamber 234 to control the downward pressure of internal membrane 116 against external membrane 118 and thus against the substrate, and fluid is pumped into or out of floating upper chamber 236 to control the contact area of internal membrane 116 against external membrane 118. The ability of carrier head 100 to control both the loading area and the pressure applied to the substrate will be explained with reference to the schematic diagrams of FIGS. 4A and 4B. Referring to FIG. 4A, a hypothetical and highly schematic polisher 300 includes a "free-floating" flexible membrane 302 that defines a pressurizable chamber 306. Assuming that no external pressures are applied to flexible membrane 302, it will be generally spherical and have an interior pressure $P_1$. However, if the membrane is compressed, e.g., between a rigid plate 304 and substrate 10, the flexible membrane will deform into an oblate shape which contacts the substrate in a generally circular contact region 308. Assuming that rigid plate 304 applies a downward force F to flexible membrane 302, force balancing requires that $F=\Delta P^*A_c$, where $\Delta P$ is the difference between the internal pressure $P_1$ in the chamber 306 and the external pressure $P_2$ surrounding the flexible membrane, and $A_c$ is the surface area of contact region 308. Thus, the diameter $D_C$ of contact region 308 will be given by:

$$D_C = \sqrt{4\frac{F}{\pi\Delta P}}$$

Figure 4B:
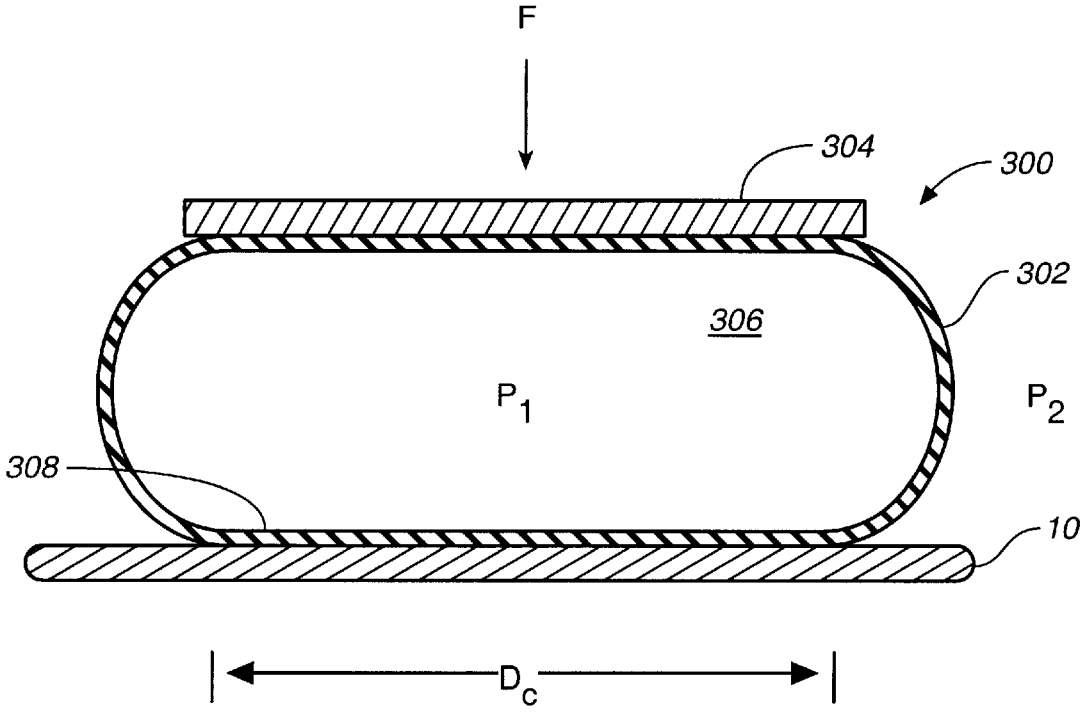

Consequently, any circular contact profile and pressure can be obtained by a two step process where the pressure $P_1$ is selected, and the applied force F is adjusted to determine the diameter of the loading area. Although FIGS. 4A and 4B illustrate the concept in a highly schematic fashion, the invention may be generally implemented by applying a downward force to a free-floating membrane chamber.

Figure 5A:
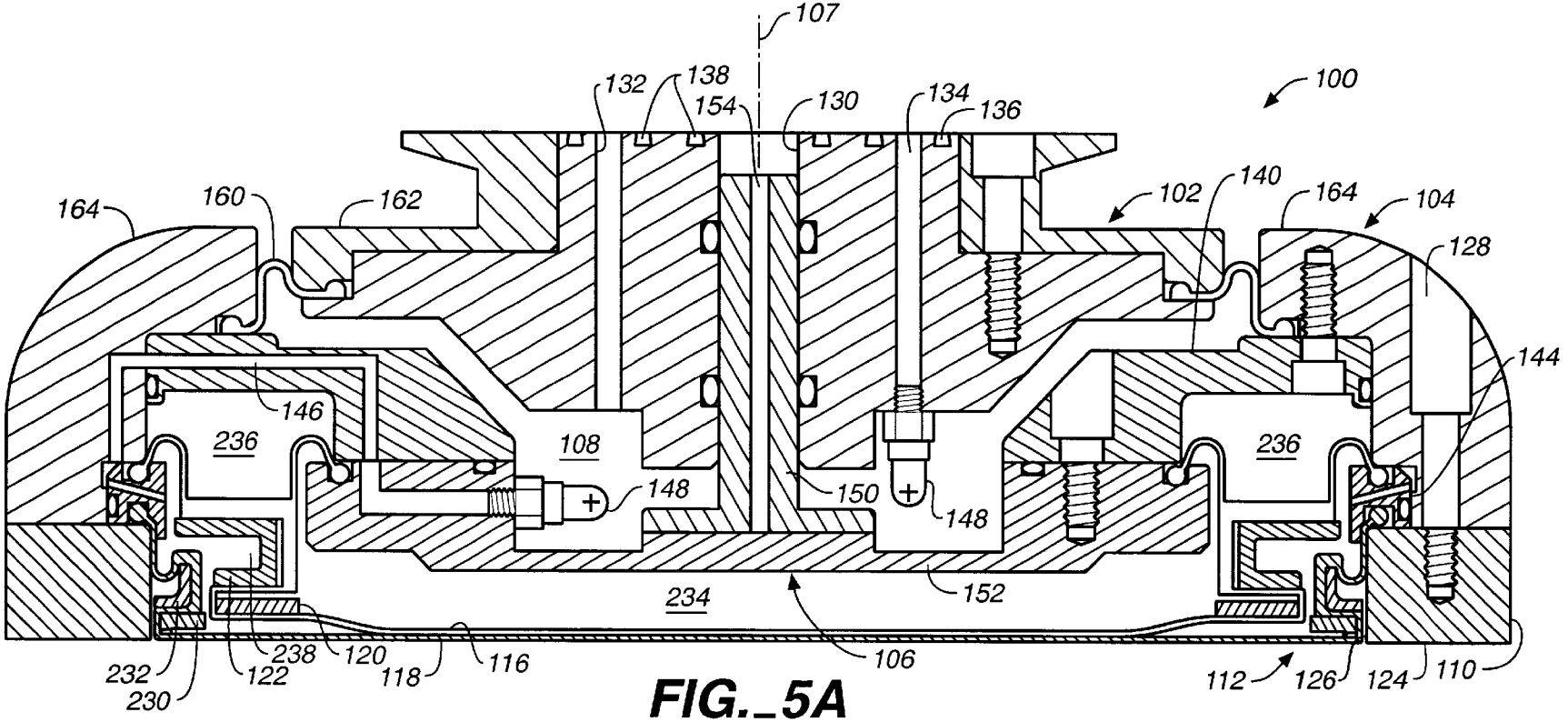
FIGS. 5A and 5B are schematic cross-sectional views illustrating the variable loading area of an internal flexible membrane from the carrier head of FIG. 2 against the substrate.
Figure 5B:
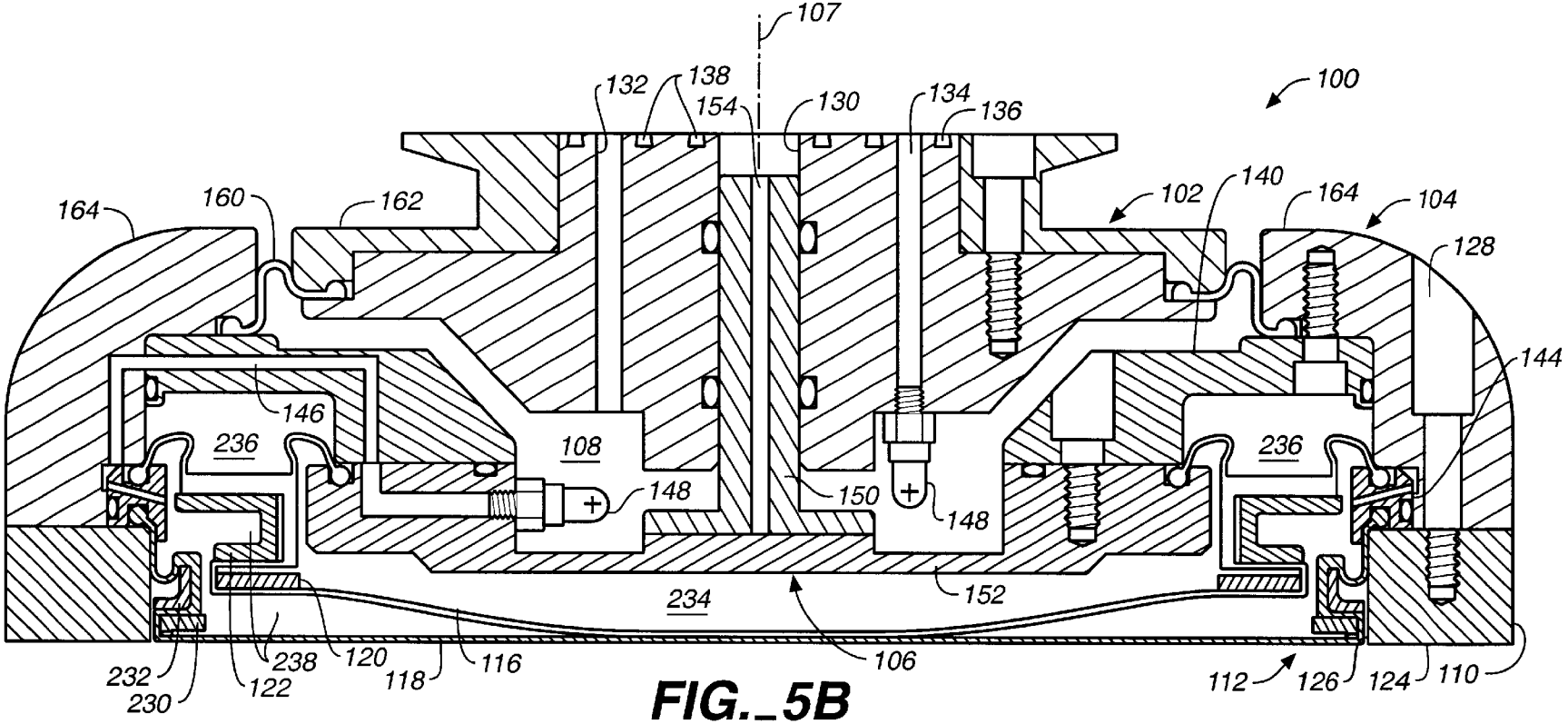

Referring to FIGS. 5A and 5B, the contact area of internal membrane 116 against external membrane 118, and thus the loading area in which pressure is applied to substrate 10, may be controlled by varying the pressure in floating upper chamber 236. By pumping fluid out of floating upper chamber 236, L-shaped portion 202 of internal membrane 116 is drawn upwardly, thereby pulling the outer edge of central portion 200 away from external membrane 118 and decreasing the diameter of the loading area. Conversely, by pumping fluid into floating upper chamber 236, L-shaped portion 202 of internal membrane 116 is forced downwardly, thereby pushing central portion 200 of the internal membrane into contact with external membrane 118 and increasing the diameter of the loading area. In addition, if fluid is forced into outer chamber 238, L-shaped portion 202 of internal membrane 116 is forced upwardly, thereby decreasing the diameter of the loading area. Thus, in carrier head 100, the diameter of the loading area will depend on the pressures in both the upper chamber and the outer chamber.

Figure 6:
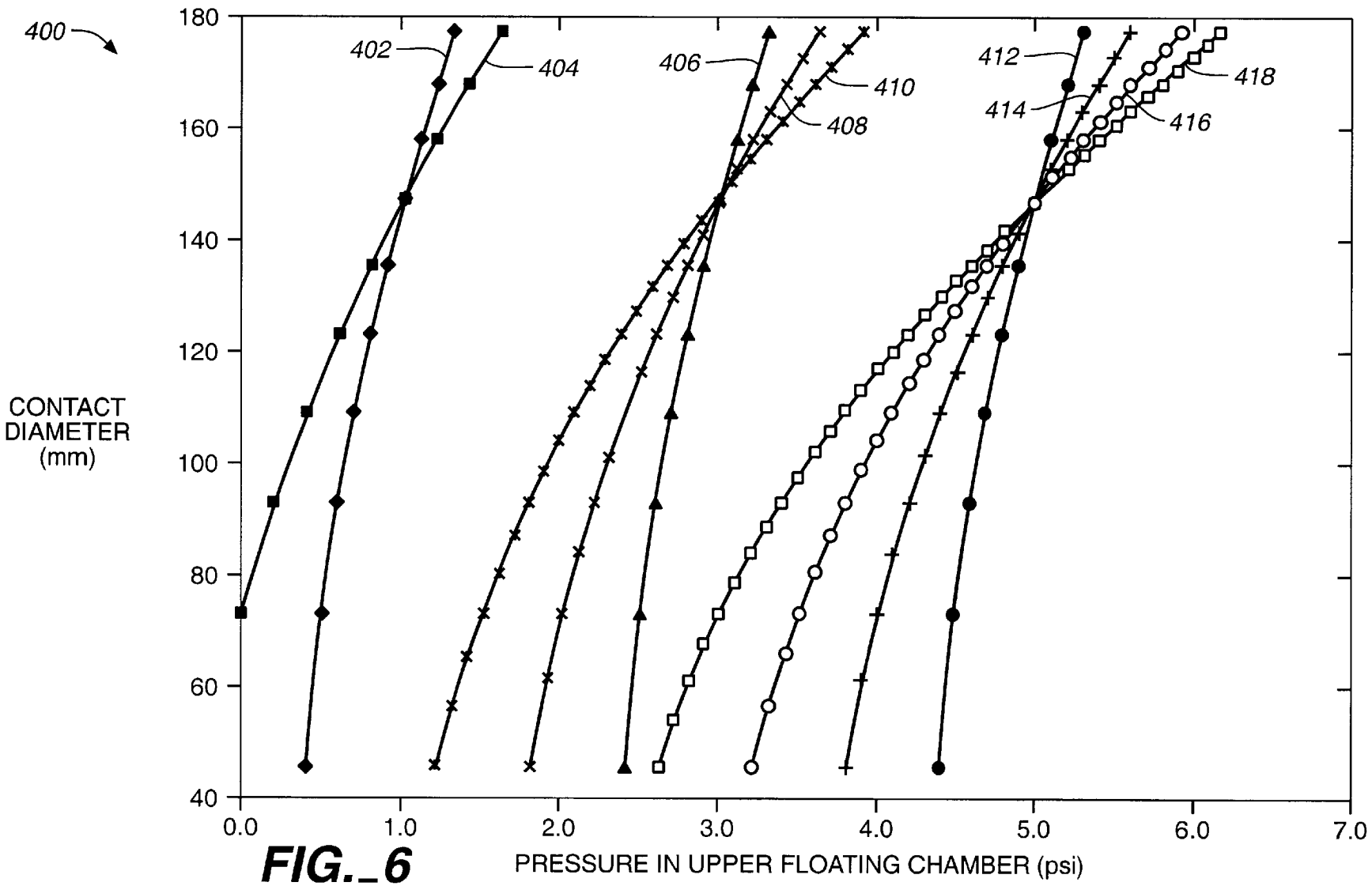
FIG. 6 is a graph illustrating the relationship between the diameter of the contact area and the pressure in the upper floating chamber.

An exemplary graph 400 of diameter of the contact area as a function of the pressures in upper chamber 235, lower chamber 234 and outer chamber 238 is shown in FIG. 6. Such a graph can be determined by experimentation or calculated by finite element analysis. In the graph in FIG. 6, the x-axis represents the pressure in the upper chamber 234 and the y-axis represents the contact area. The sets of graph lines 402–418 represent the relationship of the upper chamber pressure to contact area for various pressures in the lower chamber 236 and the outer chamber 238, as summarized by the following chart:

| Graph Line | Pressure P1 in Outer chamber 238 | Pressure P2 in Lower Chamber 234 | P2 – P1 |
|---|---|---|---|
| 402 | 1.0 | 1.5 | 0.5 |
| 404 | 1.0 | 2.0 | 1.0 |
| 406 | 3.0 | 3.5 | 0.5 |
| 408 | 3.0 | 4.0 | 1.0 |
| 410 | 3.0 | 4.5 | 1.5 |
| 412 | 5.0 | 5.5 | 0.5 |

-continued

| Graph Line | Pressure P1 in Outer chamber 238 | Pressure P2 in Lower Chamber 234 | P2 – P1 |
|---|---|---|---|
| 414 | 5.0 | 6.0 | 1.0 |
| 416 | 5.0 | 6.5 | 1.5 |
| 418 | 5.0 | 7.0 | 2.0 |

Carrier head 100 may also be operated in a "standard" operating mode, in which floating chambers 234 and 236 are vented or depressurized to lift away from the substrate, and outer chamber 238 is pressurized to apply a uniform pressure to the entire backside of the substrate.

As previously discussed, one reoccurring problem in CMP is non-uniform polishing of the substrate center. However, the controllable loading area can be used to compensate for polishing profiles in which the center of the substrate is underpolished by applying a sequence of polishing steps with different diameters of the loading area. For example, the carrier head may be used to polish a region of the substrate having radius $r_1$ for a first duration $T_1$, then polish a larger region having a radius $r_2$ for a second duration $T_2$, and then polish a still larger region having a radius $r_3$ for a third duration $T_3$. This ensures that the different regions of the substrate are polished with a total time and pressure required to reduce polishing non-uniformities.

As previously discussed, another reoccurring problem in CMP is non-uniform polishing near the edge of the substrate. However, external spacer ring 232 may be used to control the pressure distribution applied by external membrane 118 near the substrate edge. Specifically, as discussed in U.S. application Ser. No. 09/169,500, by Steven Zuniga, et al., filed Oct. 9, 1998, entitled A CARRIER HEAD WITH A FLEXIBLE MEMBRANE FOR CHEMICAL MECHANICAL POLISHING, and assigned to the assignee of the present invention, the entire disclosure of which is incorporated herein by reference, the surface area of an upper surface of the external spacer ring can be selected to adjust the relative pressure applied at the corner of the external membrane to the substrate perimeter.

In order to remove the substrate from the polishing pad, floating upper chamber 236 is pressurized to force projection 172 of external support structure 230 downwardly against the upper surface of external membrane 118. This forces the external membrane into contact with the substrate to form a seal. The floating lower chamber 234 is vented, e.g., connected to the external atmosphere, and outer chamber 238 is depressurized. This causes the external membrane 118 to be drawn inwardly to vacuum-chuck the substrate to the carrier head. Then the floating upper chamber 236 is depressurized to draw the internal and external membranes upwardly and lift the substrate off the polishing pad. Finally, loading chamber 108 is evacuated to lift base assembly 104 and substrate backing assembly away from the polishing pad.

The operation of carrier head 100 to load a substrate into the carrier head at transfer station 27, dechuck the substrate from a polishing pad at polishing station 25, and unload the substrate from the carrier head at the transfer station 27, is summarized by the following tables.

Load Operation

| Step | Initial State | Retract lower assembly | Inflate Membrane | Push substrate into Membrane | Grip Wafer |
|---|---|---|---|---|---|
| Outer | vent | vent | pressure | vent | vacuum |
| Lower | vent | vent | vent | vent | vent |
| Upper | vent | vacuum | vacuum | vacuum | vacuum |
| Ring | vacuum | vacuum | vacuum | vacuum | vacuum |

Time delays may be taken after the inflation, pushing and griping steps, respectively.

Dechuck Operation

| Step | Initial State | Apply Seal Force | Grip Substrate | Lift Substrate from Pad | Lift Ring from Pad |
|---|---|---|---|---|---|
| Outer | vent | vent | vacuum | vacuum | vacuum |
| Lower | vent | vent | vent | vent | vent |
| Upper | vent | pressure | pressure | vacuum | vacuum |
| Ring | pressure | pressure | pressure | pressure | vacuum |

Time delays may be taken after the sealing, gripping and lifting steps, respectively.

Unload Operation

| Step | Initial State | Extend Lower Assembly | Release Substrate | Eject Substrate | Deflate Membrane |
|---|---|---|---|---|---|
| Outer | vacuum | vacuum | vent | vent | vent |
| Lower | vent | vent | vent | pressure | vent |
| Upper | vacuum | pressure | vent | vent | vent |
| Ring | vacuum | vacuum | vacuum | vacuum | vacuum |

Time delays may be taken after the lowering and ejection steps, respectively.

Figure 7A:
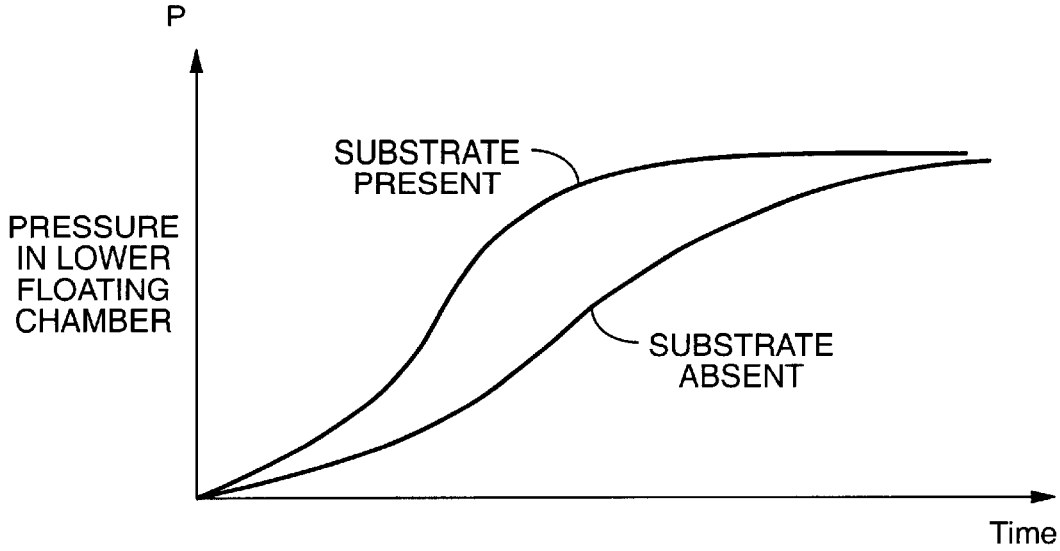
FIGS. 7A and 7B are a graph illustrating the pressure and derivative of the pressure (dP/dt) in the lower floating chamber as a function of time during a substrate detection procedure.
Figure 7B:
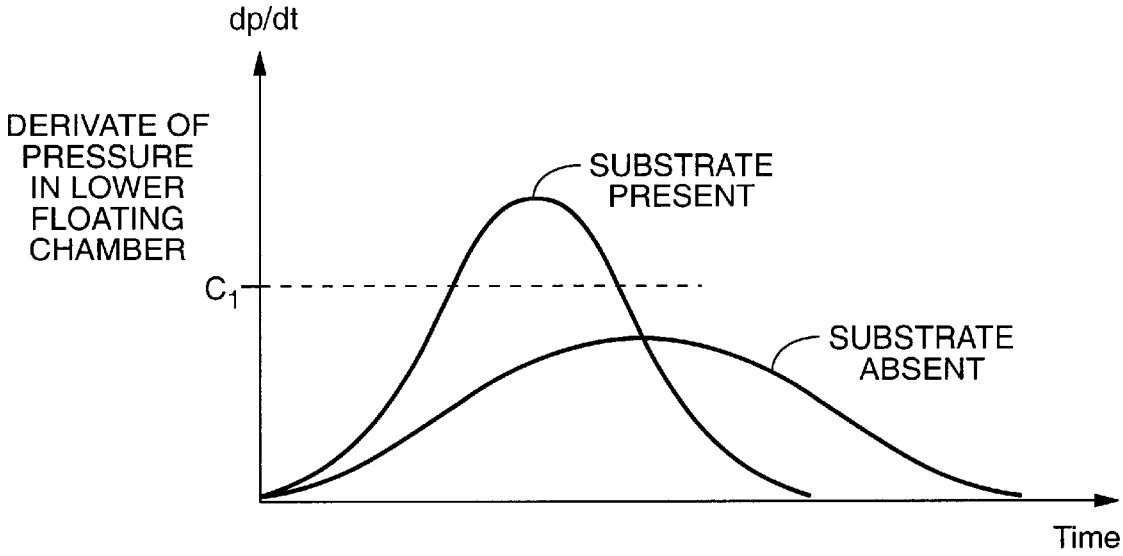

In order to determine whether the substrate was successfully attached to the carrier head after the loading or dechucking operations, the CMP apparatus may perform a substrate detection procedure. This procedure starts with outer chamber 238, upper floating chamber 236 and loading chamber 108 under vacuum, and lower floating chamber 234 vented. The lower floating chamber 234 is connected to a pressure source at a fixed pressure. Referring to FIG. 7A, the pressure in the lower floating chamber is measured as a function of time. Referring to FIG. 7B, the first derivative (dP/dt) of the pressure in the lower floating chamber is calculated as the chamber is pressurized. If the substrate is not present, the lower chamber will bow outwardly and have room to expand. In contrast, if the substrate is present and chucked to the carrier head, the volume in the lower chamber will be limited, and consequently the pressure in the lower chamber will rise more quickly. Therefore, if the substrate may be detected by determining whether the derivative dP/dt is exceeds a critical value $C_1$. This critical value $C_1$ may be determined experimentally. If the derivative dP/dt exceeds the critical value $C_1$, then the substrate is present. On the other hand, If the derivative dP/dt does not exceed the critical value $C_1$, then the substrate is absent. Lower floating chamber 234 may be returned to a vacuum after the substrate detection procedure is complete.

Figure 8:
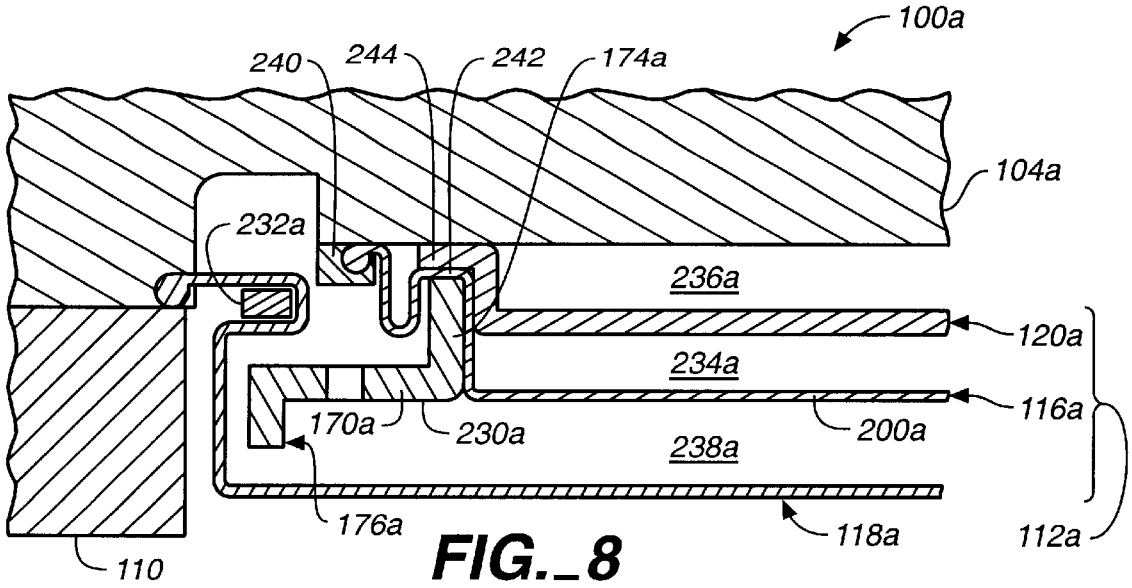
FIG. 8 is a schematic cross-sectional view of a carrier head having an internal support plate.

Referring to FIG. 8, in another embodiment, carrier head 100*a* includes a generally disk-shaped internal support plate 120*a* that provides a barrier between floating upper chamber 236*a* and floating lower chamber 234*a*. The internal membrane 116*a* is a generally circular sheet, with a central portion 200*a*, an edge portion 240 secured to base assembly 104*a*, and an annular interior region or flap 242 secured to an outer edge 244 of internal support plate 120*a*. The central portion 200*a* of the interior membrane extends beneath internal support plate 120*a* to define floating lower chamber 234*a*, whereas the volume between the backing plate and the base assembly that is sealed by edge portion 240 of internal membrane 116*a* defines floating upper chamber 236*a*. The disk-shaped internal support plate 120*a* increases the contact area between floating upper chamber 236*a* and floating lower chamber 234*a*.

The external support structure 230*a* may include a ring-shaped portion 170*a*, an annular flange portion 178*a* that projects upwardly from an inner edge of ring-shaped portion 170*a*, and a projection 172*a* that extends downwardly from the outer edge of ring-shaped portion 170*a* to contact an upper surface of external membrane 118*a*. The flange portion 178*a* of external support structure 230*a* may be secured to internal support plate 120*a* or to internal membrane 116*a*. Alternatively, external support structure 230*a* may be free-floating in outer chamber 238.

Carrier head 100*a* functions in a fashion similar to carrier head 100. Specifically, the pressure in floating upper chamber 236*a* controls the contact area of the internal membrane against the upper surface of the external membrane, and the pressure in floating lower chamber 234*a* controls the pressure applied to the substrate in the loading area. To remove a substrate from the polishing pad, floating upper chamber 236*a* is pressurized to force projection 172*a* on external support structure 230*a* against the upper surface of external membrane 118*a*. This presses the external membrane against the substrate to form a fluid-tight seal therebetween. Then the floating lower chamber is vented, and outer chamber 238*a* is depressurized to pull the external membrane against the internal membrane. Finally, the floating upper chamber is depressurized to pull the substrate off the polishing pad.

Figure 9:
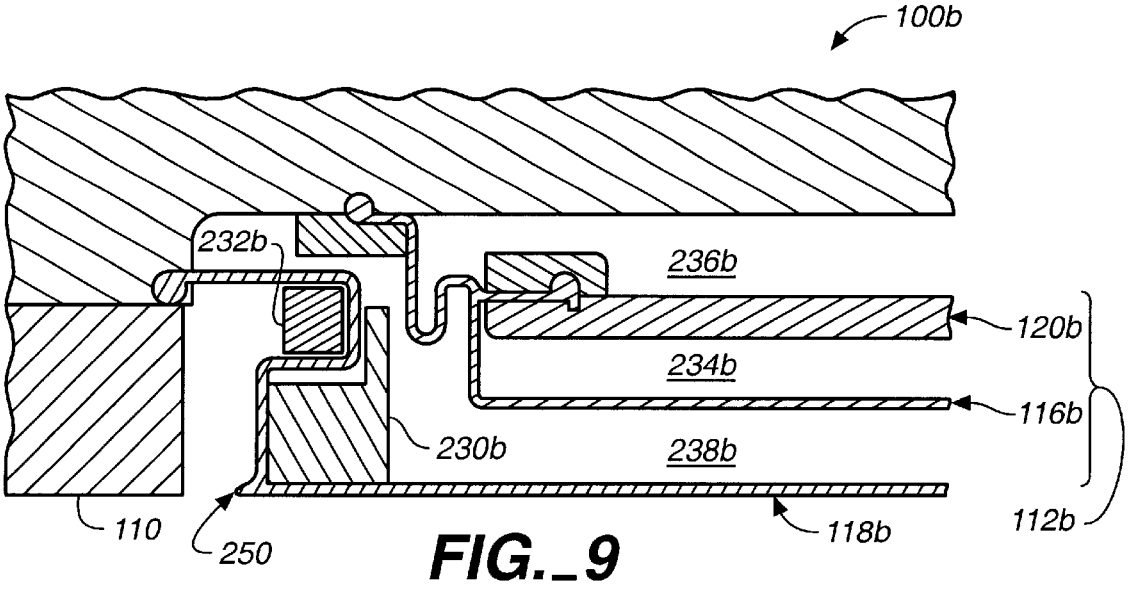
FIG. 9 is a schematic cross-sectional view of a carrier head having a flexible membrane with a lip.

Referring to FIG. 9, in another embodiment, carrier head 100*b* may include an external membrane 118*b* having an annular lip 250. When outer chamber 238*c* is evacuated, lip 250 may be pulled against substrate 10 to form a seal and improve the vacuum-chucking of the substrate, as described in U.S. patent application Ser. No. 09/149,806 by Zuniga, et al., filed Aug. 31, 1998, entitled A CARRIER HEAD FOR CHEMICAL MECHANICAL POLISHING, and assigned to the assignee of the present invention, the entire disclosure of which is incorporated herein by reference.

Figure 10:
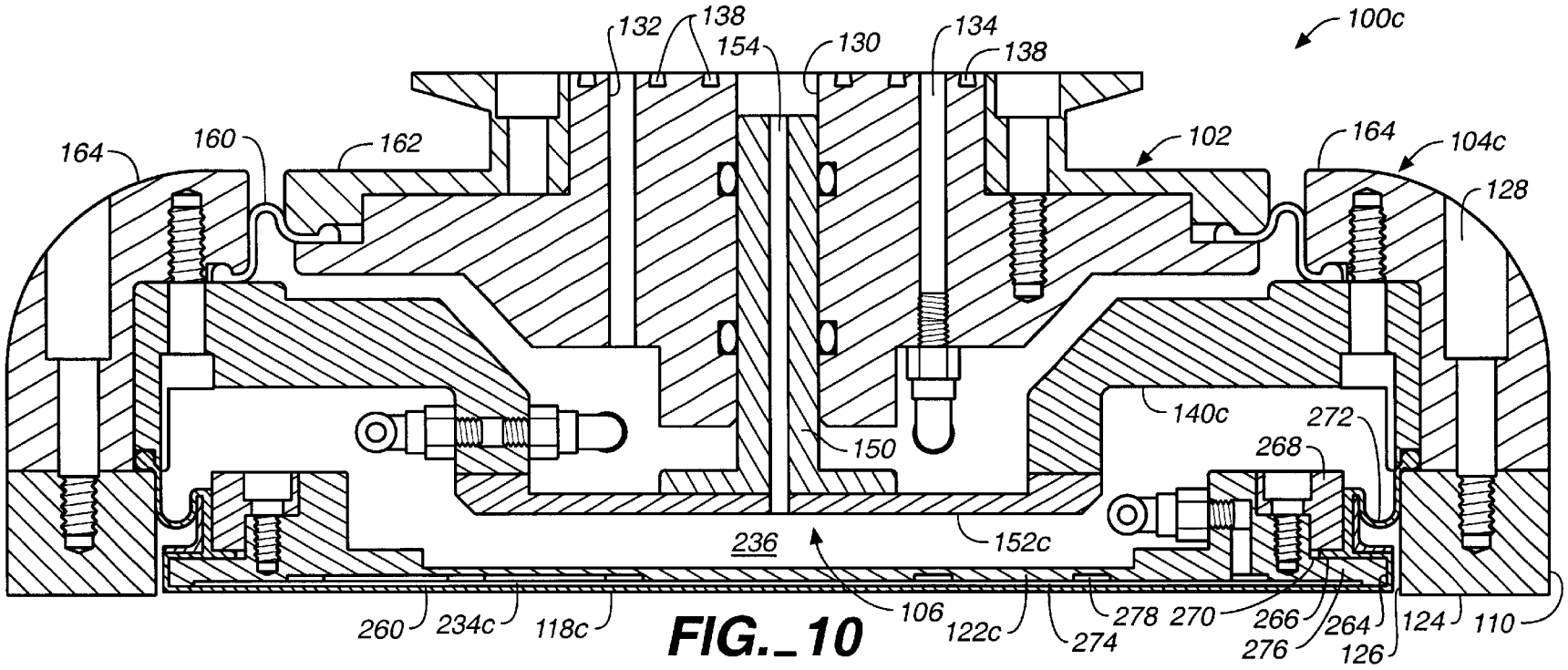
FIG. 10 is a schematic cross-sectional view of a carrier head having a flexible membrane that directly contacts the substrate in a variable loading area.

Referring to FIG. 10, in another embodiment, carrier head 100*c* includes a single flexible membrane 118*c* and a disk-shaped backing structure 122*c*. A center portion 260 of flexible membrane 118*c* extends below backing structure 122*c* to provide a mounting surface to engage the substrate. A perimeter portion 262 of the flexible membrane extends upwardly and inwardly around a cylindrical rim 264 of the backing structure. The perimeter portion 262 includes an inner flap 266 which is clamped between a clamp ring 268 and an upper surface 270 of backing structure 122*c*, and an outer flap 272 which wraps around spacer ring 120*c* to be clamped between retaining ring 110*c* and annular body 140*c*. Thus, the volume between backing structure 122*c* and flexible membrane 118 defines a pressurizable floating lower chamber 234*c*, and the volume between base assembly 104 and backing structure 122*c* that is sealed by inner and outer flaps 266 and 272 defines a pressurizable floating upper chamber 236*c*.

One pump may be connected to floating upper chamber 236*c* by passage 154 in gimbal rod 150, and another pump may be connected to floating lower chamber 234*c* by passage 134 in housing 102, passage 280 in base assembly 104*c*, and a passage 282 through backing structure 122*c*. Fixtures 284 and 286 provide attachment points for flexible tubing to fluidly couple the passages the passages through the base assembly and the backing structure to connect passage 134 to floating lower chamber 234*c*.

The bottom surface 274 of the backing structure may have a projection 276 that extends downwardly from an outer edge of the structure. A plurality of grooves 278 may also be formed in bottom surface 274 of backing structure 122*c* to ensure that fluid can be evacuated from between the backing structure and the flexible membrane.

By controlling the pressure in the upper and floating lower chambers, both the contact pressure and loading area of flexible membrane 118*c* against the substrate can be controlled. To remove the substrate from the polishing pad, floating upper chamber 236*c* is pressurized to force projection 276 downwardly and create a seal between the substrate and flexible membrane, and then floating lower chamber 234*c* is evacuated to vacuum-chuck the substrate to the carrier head.

Figure 11:
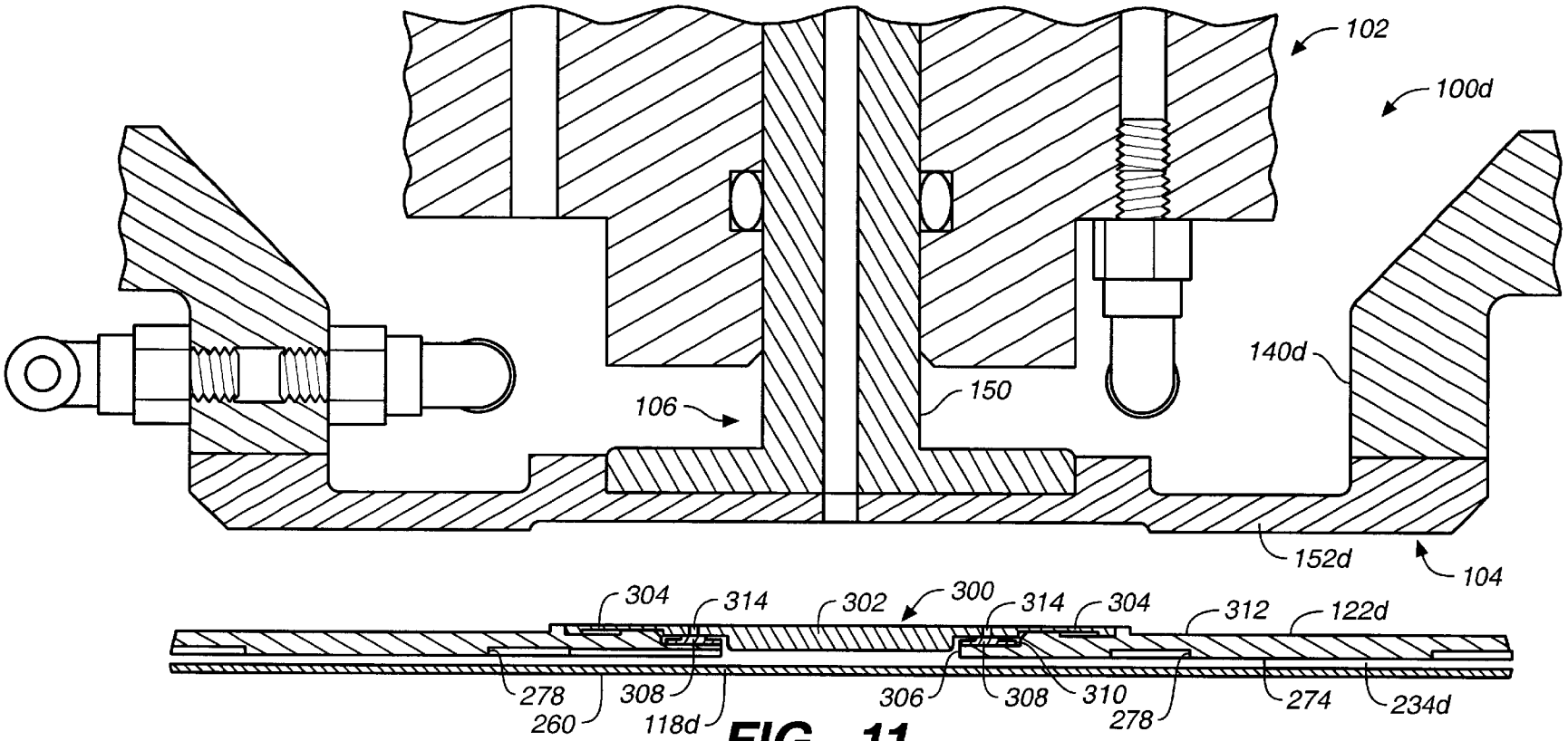
FIG. 11 is a schematic cross-sectional view of carrier head having a valve for sensing the presence of a substrate.

Referring to FIG. 11, in another embodiment, carrier head lood, which is similar in construction to carrier head 100*c*, may include a valve 300 in backing structure 122*d* to fluidly couple upper chamber 236*d* to lower chamber 234*d*. Valve 300 includes a disk-shaped valve body 302 and an annular valve flange 304. Valve body 302 may fit in an aperture 306 in backing structure 122*d*, and valve flange 304 may be adhesively secured to a top surface 312 of backing structure 122*d*. An annular seal 308 fits in a shallow depression 310 in top surface 312 surrounding aperture 306. A plurality of vertical channels 314 may be formed through disk-shaped valve body 302 above seal 308 to fluidly couple lower chamber 234*d* and upper chamber 236*d*. Valve flange 304 acts as a flexure spring to biases valve body 302 downwardly so that vertical channels 314 abut annular seal 308 to close the valve. However, if valve body 302 is forced upwardly, then the seal will no longer be contact the valve body and fluid may leak through channels 314. As such, valve 300 will be open and lower chamber 234*d* and upper chamber 236*d* will be in fluid communication via channels 314.

Valve 300 may be used to sense whether a substrate has been chucked to flexible membrane 118*d*. Specifically, a first measurement of the pressure in upper chamber 234*d* can be made with a pressure gauge (not shown) after the upper chamber is pressurized but before the lower chamber is evacuated. The upper chamber 234*d* should be isolated from the pump that pressurizes or evacuates that chamber. Then, after the lower chamber is evacuated, a second measurement of the pressure in the upper chamber is made by means of the pressure gauge. The first and second pressure measurements may be compared to determine whether the substrate was successfully vacuum-chucked to the carrier head.

If the substrate was successfully vacuum-chucked, flexible membrane 118*d* will be maintained in close proximity to the substrate by a low pressure pocket between the substrate and the flexible membrane. Consequently, valve 300 will remain biased in its closed position, and the pressure in the upper chamber will remain constant or may increase. On the other hand, if the substrate is not present or is not vacuum-chucked to the carrier head, then when lower chamber 234*d* is evacuated, flexible membrane 118*d* will deflect upwardly. The flexible membrane will thus apply an upward force to valve body 302 and will open valve 300, thereby fluidly connecting upper chamber 234*d* to upper chamber 236*d*. This permits fluid to be drawn out of upper chamber 236*d* through lower chamber 234*d*. Consequently, the resulting pressure in the upper chamber will be lower if the substrate is not present or is not vacuum-chucked to the flexible membrane than if the substrate is properly attached. This difference may be detected to determine whether the substrate is chucked to the carrier head. Similar apparatus and methods for sensing the presence of a substrate in a carrier head are described in pending U.S. application Ser. No. 08/862,350, by Boris Govzman et al., filed May 23, 1997, entitled A CARRIER HEAD WITH A SUBSTRATE DETECTION MECHANISM FOR A CHEMICAL MECHANICAL POLISHING SYSTEM, and assigned to the assignee of the present invention, the entire disclosure of which is incorporated herein by reference.

A variety of configurations are possible for a carrier head that implements the invention. For example, the floating upper chamber can be either an annular or a solid volume. The upper and lower chambers may be separated either by a flexible membrane, or by a relatively rigid backing or support structure. The substrate can be contacted directly by a flexible membrane in a variable loading area, or an internal membrane can contact the interior surface of an external membrane in a variable contact area. The support structures could be either ring-shaped or disk-shaped with apertures therethrough.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a first pressurizable chamber at least partially bounded by a first flexible membrane, a lower surface of the first flexible membrane providing a first surface to apply a pressure to a substrate in a loading area having a controllable size; and a second pressurizable chamber positioned to apply a downward force to the first chamber, wherein the first and second chambers are configured such that a first pressure in the first chamber controls the pressure applied to the substrate in the loading area, and a second pressure in the second chamber controls the size of the loading area.

2. The carrier head of claim 1, further comprising a vertically movable base that forms at least part of an upper boundary of the second pressurizable chamber.

3. The carrier head of claim 2, further comprising a housing connectable to a drive shaft and a third chamber disposed between the housing and the base.

4. The carrier head of claim 3, further comprising a retaining ring connected to the base to maintain the substrate beneath the carrier head.

5. The carrier head of claim 1, wherein a rigid member forms a boundary between the first and second chambers.

6. The carrier head of claim 1, wherein a flexible member forms a boundary between the first and second chambers.

7. The carrier head of claim 1, wherein the second chamber forms a generally annular volume.

8. The carrier head of claim 1, wherein the second chamber forms a generally solid volume.

9. The carrier head of claim 1, wherein the lower surface of the first flexible membrane provides a mounting surface for the substrate.

10. The carrier head of claim 1, further comprising a second flexible membrane extending beneath the second flexible membrane to provide a mounting surface for the substrate.

11. The carrier head of claim 10, wherein the volume between the first flexible membrane and the second flexible membrane defines a third pressurizable chamber.

12. The carrier head of claim 11, further comprising a first support structure located in the first chamber, and wherein the first flexible membrane extends around an outer surface of the first support structure.

13. The carrier head of claim 12, further comprising a second support structure located in the third chamber between the first and second flexible membranes and positioned to surround the first supports structure.

14. The carrier head of claim 13, wherein the second support structure is generally annular in shape.

15. The carrier head of claim 14, further comprising a first spacer ring positioned in the third chamber between the first and second flexible membranes, and wherein the first flexible membrane extends in a serpentine path between the first structure and the first spacer ring, around an inner surface of the first spacer ring, and outwardly around an upper surface of the first spacer ring.

16. The carrier head of claim 15, further comprising a second spacer ring located outside the third chamber above the second support ring, and wherein the second flexible membrane extends in a serpentine path between the second support structure and the second spacer ring, around an inner surface of the second spacer ring, and outwardly around an upper surface of the second spacer ring.

17. The carrier head of claim 16, wherein a portion of the first spacer ring extends over a portion of the second spacer ring, so that pressurization of the second chamber applies a downward force to the second support ring.

18. The carrier head of claim 17, wherein the second support ring includes an annular projection extending downwardly to contact a top surface of the second flexible membrane.

19. The carrier head of claim 10, wherein the first flexible membrane is movable into contact with an upper surface of the second flexible membrane in the loading area to apply pressure to the substrate.

20. The carrier head of claim 19, wherein the lower surface of the first flexible membrane is textured to provide fluid flow between the first and second flexible membranes when they are in contact.

21. The carrier head of claim 1, further comprising a first support structure positioned inside the first chamber, and wherein the first flexible membrane extends around an outer surface of the first support structure.

22. The carrier head of claim 21, wherein the first support structure is generally annular in shape.

23. The carrier head of claim 21, wherein the first support structure comprises a generally disk-shaped body having a plurality of apertures therethrough.

24. The carrier head of claim 21, further comprising a first spacer ring positioned outside the first chamber, and wherein the first flexible membrane extends in a serpentine path between the first structure and the first spacer ring, around an inner surface of the first spacer ring, and outwardly around an upper surface of the first spacer ring.

25. A carrier head for chemical mechanical polishing, comprising:

a base;

a first flexible membrane portion that extends beneath the base and defines a first pressurizable chamber, a lower surface of the first flexible membrane portion providing a mounting surface to apply a pressure to a substrate in a loading area having a controllable size; and a second flexible membrane portion that couples the first flexible membrane portion to the base and defines a second pressurizable chamber so that a first pressure in the first pressurizable chamber controls the pressure applied to the substrate in the loading area, and a second pressure in the second chamber controls the size of the loading area.

26. A carrier head for chemical mechanical polishing, comprising:

a base;

a first flexible membrane portion that extends beneath the base to define a first pressurizable chamber, a lower surface of the first flexible membrane portion providing a mounting surface for a substrate;

a second flexible membrane portion that extends beneath the base and defines a second pressurizable chamber, a lower surface of the second flexible membrane portion contacting a top surface of the first flexible membrane in a loading area having a controllable size; and a third flexible membrane portion that couples the second flexible membrane portion to the base and defines a third pressurizable chamber so that a first pressure in the second pressurizable chamber controls the pressure applied to the substrate in the loading area, and a second pressure in the third chamber controls the size of the loading area.

27. A carrier head for chemical mechanical polishing, comprising:

a first biasing member including a first pressure chamber, a lower surface of the first pressure chamber bounded by a flexible membrane that provides a first surface to apply a load to a substrate in a loading area having a controllable size; and a second biasing member connected to the first biasing member, the second biasing member controlling the vertical position of the first biasing member so that the second biasing member controls the size of the loading area and the first biasing member controls the pressure applied to the substrate in the loading area.

28. A carrier head for chemical mechanical polishing, comprising:

a flexible membrane that provides a mounting surface for a substrate;

means for controlling a size of a loading area in which a load is applied to the substrate; and means for controlling a pressure applied to the substrate in the loading area.

* * * * *